US010652670B2

(12) United States Patent
Rosenkranz et al.

(10) Patent No.: US 10,652,670 B2
(45) Date of Patent: May 12, 2020

(54) METHOD FOR OPERATING A HEARING AID AND HEARING AID

(71) Applicant: SIVANTOS PTE. LTD., Singapore (SG)

(72) Inventors: Tobias Daniel Rosenkranz, Erlangen (DE); Sebastian Best, Erlangen (DE); Stefan Petrausch, Erlangen (DE); Tobias Wurzbacher, Fuerth (DE); Christoph Lueken, Langensendelbach (DE); Nicola Cebulla, Erlangen (DE); Christos Oreinos, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 181 days.

(21) Appl. No.: 15/852,150

(22) Filed: Dec. 22, 2017

(65) Prior Publication Data

US 2018/0184217 A1 Jun. 28, 2018

(30) Foreign Application Priority Data

Dec. 22, 2016 (DE) ..... 10 2016 226 112

(51) Int. Cl.
*H04R 25/00* (2006.01)

(52) U.S. Cl.
CPC ..... *H04R 25/505* (2013.01); *H04R 25/353* (2013.01); *H04R 25/453* (2013.01); *H04R 25/60* (2013.01); *H04R 2225/41* (2013.01)

(58) Field of Classification Search
CPC .... H04R 25/35; H04R 25/353; H04R 25/505; H04R 25/554; H04R 2225/025; H04R 2225/39; H04R 2225/41; H04R 2225/43; H04R 2460/05
See application file for complete search history.

(56) References Cited

U.S. PATENT DOCUMENTS

| | | | |
|---|---|---|---|
| 8,170,248 | B2 | 5/2012 | Hersbach et al. |
| 8,571,242 | B2 | 10/2013 | Baechler et al. |
| 8,848,953 | B2 | 9/2014 | Pape et al. |
| 8,861,759 | B2 | 10/2014 | Pape et al. |

(Continued)

FOREIGN PATENT DOCUMENTS

| | | | |
|---|---|---|---|
| DE | 102010025918 | A1 | 1/2012 |
| EP | 2369859 | A2 | 9/2011 |
| EP | 2394442 | A1 | 12/2011 |

(Continued)

*Primary Examiner* — Kile O Blair

(74) *Attorney, Agent, or Firm* — Laurence A. Greenberg; Werner H. Stemer; Ralph E. Locher

(57) ABSTRACT

A method operates a hearing aid which has at least one input transducer and at least one output transducer. An input signal is generated by the at least one input transducer from a sound signal in the environment. From the input signal, a classification of a hearing situation of the environment is determined and/or at least one of four parameters including tonality, loudness, stationarity and reverberation time is determined for the sound signal of the environment. A first intermediate signal is generated in dependence on the input signal by signal processing. Wherein by the classification of the hearing situation and by at least one of the four parameters of tonality, loudness, stationarity and reverberation time, at least one parameter of a frequency distortion is predetermined. The frequency distortion predetermined in this way is applied to the first intermediate signal.

12 Claims, 3 Drawing Sheets

(56) References Cited

U.S. PATENT DOCUMENTS

| | | | |
|---|---|---|---|
| 8,873,781 | B2 | 10/2014 | Hannemann et al. |
| 8,953,818 | B2 | 2/2015 | Elmedyb et al. |

FOREIGN PATENT DOCUMENTS

| | | | |
|---|---|---|---|
| EP | 2519033 | A2 | 10/2012 |
| EP | 2590437 | A1 | 5/2013 |
| WO | 2007053896 | A1 | 5/2007 |
| WO | 2010088960 | A1 | 8/2010 |

METHOD FOR OPERATING A HEARING AID AND HEARING AID

CROSS-REFERENCE TO RELATED APPLICATION

This application claims the benefit, under 35 U.S.C. § 119, of German patent application DE 10 2016 226 112.6, filed Dec. 22, 2016; the prior application is herewith incorporated by reference in its entirety.

BACKGROUND OF THE INVENTION

Field of the Invention

The invention relates to a method for operating a hearing aid which contains at least one input transducer and at least one output transducer. An input signal is generated by the at least one input transducer from a sound signal of the environment and a first intermediate signal is generated in dependence on the input signal by signal processing.

In the operating of a hearing device, in particular of a hearing aid, a sound signal of the environment is typically converted into an electrical signal by an input transducer and processed in a signal processing unit in accordance with the audiological requirements of the user and in this process, in particular, amplified in dependence on frequency. The processed signal is converted by an output transducer into an output sound signal which is supplied to the ear of the user. In this process, the situation may arise in operation even when the hearing aid is used as intended that the sound signal of the environment becomes superimposed on the output sound signal of the hearing aid when it meets the ear of the user. This can be due, in particular, to the fact that hearing aids are typically constructed in such a manner that they do not completely shut the auditory canal of the user in order to thus avoid occlusion effects which are usually sensed as being disturbing by the user. If necessary, a small hole (vent) can also be provided in the housing of the hearing aid for this purpose.

The input signal generated from the sound signal of the environment by the input transducer then experiences in the signal processing unit a time delay particularly with processes for frequency band filtering which cannot be arbitrarily reduced by technical measures of the signal processing. This then leads to the output sound signal which has been generated in the hearing aid from the output signal of the signal processing becoming heterodyned with the sound signal of the environment with a slight time delay. As a result, so-called comb filter effects can be produced in the overall sound signal which is perceived by the user. Due to the time delay in the heterodyning of the output sound signal of the hearing aid with the direct sound signal of the environment, individual signal components are interfered constructively in dependence on the time delay and frequency which leads to an amplification whereas for frequencies which are a half-integral multiple of the inverse time delay a considerable weakening in the total sound signal can occur due to a destructive interference. Comb filter effects can be perceived as very unpleasant by the user since they can significantly change the overtone spectra of the audible sound signal as a consequence of the destructive interference, for example due to the deletion of certain frequencies, and/or can "impress" a harmonic structure onto a wideband noise. This applies even more against the background that a significant change of the input signal by the signal processing as a consequence of the typical audiological requirements of a user usually only takes place at distinctly higher frequencies than those for which comb filter effects can already be perceived as unpleasant and thus, at latter frequencies, the output sound signal does not have any significant spectral differences from the direct sound signal which favors the formation of comb filter effects.

Published, European patent application EP 2 590 437 A1 (corresponding to U.S. Pat. No. 8,861,759) discloses a method for adaptive suppression of an acoustic feedback in a hearing aid, the adaptation process being periodically activated so that in the active state, an adaptive filter having a variable step length maps the acoustic feedback path. In this context, an algorithm for frequency shift or frequency compression can be started. In addition to the periodic activation, the duration of an activity or inactivity state can then also be changed in dependence on a hearing situation.

Published, non-prosecuted German patent application DE 10 2010 025 918 A1 (corresponding to U.S. Pat. No. 8,848,953) mentions a method in which, when the occurrence of an acoustic feedback is found in a hearing device, a frequency shift to the output signal to be output by the loudspeaker is applied for the better suppression of the feedback.

SUMMARY OF THE INVENTION

The invention is therefore based on the object of specifying a method for operating a hearing aid by which unpleasant consequences of comb filter effects can be avoided in the simplest possible manner for the user without significantly changing or impairing the user-specific signal processing whilst doing so.

According to the invention, the object is achieved by a method for operating a hearing aid which contains at least one input transducer and at least one output transducer. An input signal is generated by the at least one input transducer from a sound signal of the environment, and by means of the input signal, a classification of a hearing situation of the environment takes place and/or at least one of the four parameters of tonality, loudness, stationarity and reverberation time is determined for the sound signal of the environment. A first intermediate signal is derived in dependence on the input signal by signal processing. By means of the classification of the hearing situation and by means of at least one of the four parameters of tonality, loudness, stationarity and reverberation time, at least one parameter of a frequency distortion is predetermined. The frequency distortion predetermined in this way is applied to the first intermediate signal. Advantageous and partially independent inventive embodiments are provided in the subclaims and in the subsequent description.

An input transducer generally contains an acousto-electric transducer which is configured to convert the sound signal of the environment into a corresponding electrical or electromagnetic signal, that is to say, for example, a microphone. An output transducer generally contains an electro-acoustic transducer which is configured to generate an output sound signal from an electrical and/or electromagnetic signal, that is to say, for example, a loudspeaker or a sound generator for auditory bone conduction. In this context, signal processing is understood to be in particular processing of the input signal or a signal derived from the input signal by means of user-specifically determined specifications, that is to say, in particular, a frequency band-dependent amplification and/or noise suppression, the respective gain factors in the individual frequency bands being configured for the correction of a possible loss of hearing of the user in accordance with his audiogram.

A generation of the first intermediate signal in dependence on the input signal is here understood to mean, in particular, that the signal processing receives the input signal directly as input variable and generates from this the first intermediate signal or that the signal processing receives a signal directly dependent on the input signal and generates from this the first intermediate signal, that is to say, for example, the input signal which has been corrected by a compensation signal for compensating for an acoustic feedback. A classification of a hearing situation is to be understood, in particular, to mean that by means of measurable acoustic parameters, groups of in each case similar acoustic environments in which the user can in each case find himself again as can be expected are typified and that, in particular in dependence on this typification, adjustments can be carried out to the hearing aid and/or the signal processing. Hearing situations considered are, for example, a conversation without background noises, a conversation with background noises, hearing music, driving in the car, several conversations simultaneously, superimposed by considerable background noises (so called "cocktail party" hearing situation), etc. A classification by means of the input signal is to be understood, in particular, as a classification which uses the input signal itself directly as relevant variable or a signal directly dependent on the input signal as relevant variable, which reproduces signal changes in the input signal in a comparable manner, e.g. the input signal corrected by a compensation signal.

In this context, a frequency shift is considered, in particular, as frequency distortion which displaces the first intermediate signal by an amount to be predetermined in a frequency range to be specified. The frequency range in which the displacement is to be applied and the amount of displacement are to be specified in this case as parameters of the frequency distortion. Similarly, the frequency distortion can also be given by a frequency transposition with a more complex dependency between input frequency and output frequency. The tonality or the loudness of the sound signal of the environment can in this case be determined, in particular, by the definitions normal for these parameters in psychoacoustics, the stationarity, for example, by means of the autocorrelation function of the input signal or its level variance, in each case via a time window to be selected suitably.

In this context, the method proposes three different dependencies for specifying the at least one parameter of the frequency distortion.

If only the hearing situation is classified by the input signal, the at least one parameter of the frequency distortion is also specified only in dependence on the classification of the hearing situation. If only at least one of the four parameters of tonality, loudness, stationarity and reverberation time is determined for the sound signal of the environment, the at least one parameter of the frequency distortion is only specified in dependence on at least one of these parameters. If both a classification of the hearing situation and a determination of the abovementioned parameters takes place for the sound signal of the environment by means of the input signal, the at least one parameter of the frequency distortion can be predetermined by means of this complete information or, for example, can take place only by means of the parameters mentioned for the sound signal of the environment if the classification of the hearing situation has only taken place for adjusting the signal processing.

In this context, the invention advantageously makes use of the circumstance that the first intermediate signal derived from the input signal, which usually still has a high degree of correlation with the input signal even after the signal processing, is decorrelated from the input signal in the corresponding distorted frequency ranges via the frequency distortion and such a decorrelation, due to the resultant loss of coherence with the sound signal of the environment leads to a considerable suppression of comb filter effects. Comb filter effects occur exactly due to an acoustic heterodyning of the sound signal of the environment with an output sound signal generated by the output transducer if a fixed phase relation exists between the heterodyne signals. This fixed phase relation is then broken, however, by the frequency distortion.

In this context, it is additionally still taken into consideration in the method that comb filter effects are not sensed as equally unpleasant for any sound signals of the environment by the user. Instead, a type of overtone spectrum is artificially generated, for example, in a wideband atonal sound signal by a comb filter effect and the constructive and destructive interferences then occurring at particular frequencies, which leads to a virtually tonal perception of the sound signal which is actually a wideband signal which can be sensed as being unpleasant. On the other hand, a frequency distortion, for example in the form of a frequency shift, can lead to beats between the output sound signal of the hearing aid with frequency-shifted signal components and the direct sound signal of the environment with very tonal sound signals, particularly in the case of music, which can also be perceived as being very unpleasant whereas, in contrast, comb filter effects do not usually have any greater effects on the hearing sensation with particularly tonal signals. The invention then opens up the possibility of making a decision in a simple manner only by the hearing situation and/or parameters of the sound signal to be determined in a simple manner, whether and to what extent a formation of comb filter effects is probable at all, on the one hand, in the present case, and how the hearing sensation of the user threatens to be impaired by this, that is to say whether and how the frequency distortion is to be adjusted for suppressing the comb filter effects.

This decision is then made in the form of specifying the at least one parameter of the frequency distortion so that, in dependence on the sound signal and the present acoustic circumstances, the suppression of comb filter effects is either prioritized via the predetermined parameters of the frequency distortion or, instead, acoustic frequency superimpositions such as, e.g., beats between the output sound signal and the sound signal of the environment are prevented with priority and the at least one parameter of the frequency distortion is correspondingly predetermined. Tuning to the hearing situation is particularly advantageous in this case since it is determined anyway in most cases for the signal processing and additionally represents a particularly simple criterion for the specification of the at least one parameter of the frequency distortion. On the other hand, tuning of the frequency distortion to the at least one of the four parameters of tonality, loudness, stationarity and reverberation time of the sound signal of the environment allows a particularly detailed adaptation of the frequency distortion to the sound signal of the environment with regard to the expected perception of the output sound signal by the user.

Preferably, the at least one parameter of the frequency distortion is additionally specified in dependence on at least one parameter of the signal processing. The at least one parameter of the signal processing in this case contains, in particular, a total gain, a frequency-band-dependent gain factor or other acoustic characteristics which, in particular, are determined by an adaptation by an acoustic hearing aid engineer. Including the signal processing in the tuning of the frequency distortion by the at least one parameter offers the advantage in this case of being able to determine, in particular, frequency bands in which the formation of comb filter effects is particularly probable or improbable as a consequence of the respective amplification or lowering.

It is found to be advantageous if, by means of the classification of the hearing situation and by means of the at least one of the four parameters of tonality, loudness, stationarity and reverberation time, a comb filter parameter is determined which specifies a probability value for an occurrence and/or an intensity of a comb filter effect, wherein the at least one parameter of the frequency distortion is additionally specified in dependence on the comb filter parameter. If in this context only one hearing situation is classified or only at least one of the parameters is determined for the sound signal of the environment, the comb filter parameter is determined in accordance with the respective information present. If both a classification of the hearing situation and a determination of the at least one of the four parameters takes place for the sound signal of the environment, the comb filter parameter is determined preferably in dependence on the complete information present.

In this context, the comb filter parameter can be determined, in particular, iteratively wherein initially a preliminary value is predetermined for the at least one parameter of the frequency distortion and, by means of this preliminary value, together with the other available information, the comb filter parameter is determined when the frequency distortion is applied with the preliminary value. The final value for the at least one parameter of the frequency distortion is then predetermined in dependence on this comb filter parameter thus determined. Specifying the at least one parameter of the frequency distortion in dependence on a comb filter parameter procured in this manner allows the specification to be performed in an optimization method also dependent on other characteristics or parameters by means of the probability available and potential intensity of a comb filter effect, preferably resolved over individual frequency bands.

An output signal is preferably generated by the application of the predetermined frequency distortion to the first intermediate signal, wherein the output signal is converted into an output sound signal by at least one output transducer. Outputting the frequency distorted first intermediate signal as output signal which is directly converted into the output sound signal has the advantage that no further subsequent processes need to be taken into consideration any more for an optimum determination of the frequency distortion.

In this context, the at least one parameter of the frequency distortion is suitably predetermined additionally in dependence on an acoustic heterodyne, to be expected, of frequency-distorted signal components of the output sound signal with the sound signal of the environment. To a similar extent in which comb filter effects can form due to an acoustic heterodyning of the output sound signal without frequency distortion with the sound signal of the environment, frequency-distorted signal components of the output sound signal can also impair the hearing sensation of the user with an acoustic heterodyning with the sound signal of the environment as, e.g., in the case of a frequency displacement as frequency distortion in the form of a beat between the signal components, frequency-shifted only slightly with respect to one another, of the output sound signal and of the sound signal of the environment. If then, for example, at least one parameter of the frequency distortion is predetermined as preliminary value, for example by means of the classification of the hearing situation and/or the at least one of the four parameters of tonality, loudness, stationarity and reverberation time of the sound signal of the environment, and the present information shows that in consequence of a high degree of tonality and/or stationarity of the sound signal a distinctly perceptible beat is to be expected, this can be taken into consideration correspondingly when specifying the at least one parameter of the frequency distortion and the frequency distortion can take place only for few frequency ranges and/or with lower intensity or turned off completely.

It is found to be advantageous if the at least one parameter of the frequency distortion is additionally specified in dependence on a heterodyne, to be expected, of frequency-distorted signal components of the first intermediate signal with non-frequency-distorted signal components of the first intermediate signal in the output signal. In particular when the frequency distortion is given by a frequency shift which is to be applied only to particular frequency bands it can result in a heterodyning of frequency-shifted signal components with signal components without frequency displacement in the output signal due to the finite edge steepness of the frequency band filters at a respective dividing frequency. It is especially in the case of tonal sound signals or in the case that a considerable signal energy is present in the area of a dividing frequency, that this can lead to unpleasant artefacts. In particular, the frequency response of the input signal can thus be taken into consideration correspondingly when specifying the at least one parameter of the frequency distortion and correspondingly transitions between frequency ranges in which the frequency distortion is applied and frequency ranges without frequency distortion are specified in such a manner that a relatively low signal energy is present at the transitions in order to prevent the formation of artefacts at the transitions.

In an advantageous embodiment of the invention, the at least one parameter of the frequency distortion is predetermined by a function of a change of an output frequency in dependence on an input frequency. In this way, the frequency distortion can be characterized particularly comprehensively and tuned particularly accurately, in particular, to the present acoustic situation.

Advantageously, a frequency shift is then applied as frequency distortion, wherein the at least one parameter is predetermined by the carrier of the function and/or the value of the frequency shift. A frequency shift as frequency distortion can be achieved in a particularly simple manner in the form described since it is only necessary to implement the frequency range in which the frequency shift is to be applied, by a filter and the frequency shift occurs by a constant amount. Usually, the frequency range in which the frequency shift is to be applied, that is to say the carrier of the function, is coherent or half open so that the filter process can also be implemented without significant additional expenditure.

In a further advantageous embodiment of the invention, the frequency-distorted first intermediate signal is supplied to a feedback loop. A second intermediate signal is derived from the frequency-distorted first intermediate signal in the feedback loop, and the second intermediate signal is the input signal for suppressing an acoustic feedback. The frequency-distorted first intermediate signal contains in this case particularly the complete resultant signal after application of the frequency distortion to the first intermediate signal, that is to say including all frequency-distorted and non-frequency-distorted signal components. The acoustic feedback is produced here particularly by coupling an output sound signal of the hearing aid into the input transducer so that signal components of the output sound signal are amplified again by the signal processing. Preferably, the signal resulting from the input signal and the second intermediate signal is supplied directly to the signal processing. The occurrence of acoustic feedbacks is a general frequently recurring problem for hearing aids where, for better suppression of the acoustic feedback, especially in the case of particularly tonal sound signals, the second sound signal is preferably to be decorrelated from the input signal in order to prevent the formation of artefacts. Such decorrelation can be achieved in particular, by the present frequency distortion.

Preferably, in this case the at least one parameter of the frequency distortion is specified additionally in dependence on the acoustic feedback to be suppressed. If, for example, a particularly tonal sound signal is present, it can be advantageous a priori for the hearing sensation of the user to select the range of application and/or the intensity of the frequency distortion to be rather low and for that to accept the comb filter effects often not felt to be critical in tonal signals. If, however, an acoustic feedback occurs, a frequency distortion can still be of advantage against the actual specifications which were made for the sound signal of the environment according to the classification of the hearing situation and/or for the sound signal of the environment, in order to be able to suppress the acoustic feedback particularly effectively since whistling tones otherwise occurring would be even more disadvantageous for the hearing sensation of the user.

In a further advantageous embodiment of the invention, a data signal corresponding to an audio signal is received by a signal receiver of the hearing aid, wherein the at least one parameter of the frequency distortion is specified additionally in dependence on the audio signal. In this context, a signal receiver is understood to be, in particular, an antenna device which is configured for receiving an electromagnetic transmission signal and contains a so-called "telecoil" which is configured for receiving an inductive transmission signal. The data signal corresponding to an audio signal contains here, in particular, an electromagnetic or inductive signal in which, according to a corresponding protocol, the audio signal is coded so that, after a reception of the data signal by the signal receiver and after a subsequent decoding of the data signal, the acoustic information of the audio signal is available in the hearing aid. This can be the case, in particular, by a streaming signal of an entertainment electronics device, e.g. via Bluetooth or the like.

For the specification of the at least one parameter of the frequency distortion in additional dependence on the audio signal, at least one of the four parameters of tonality, loudness, stationarity and reverberation time and/or a time difference between the audio signal and the input signal can in particular in this case be determined for the audio signal. If, for example, in television, by using a streaming signal of the television receiver for the hearing aid by simultaneously using the loudspeaker of the television receiver, that the audio signal coded in the streaming signal has only slight tonal components at a time, the parameters of the frequency distortion are tuned to the signal delay occurring between the audio signal and the input signal containing the loudspeaker signal of the television receiver, e.g. via an amount and a range of application of a frequency shift as frequency distortion.

If at a later time, a higher tonality is found in the audio signal, the parameters of the frequency distortion can be changed accordingly and the circumstance can also be considered that the input signal can still comprise many more sound signals in addition to the audio signal coded in the streaming signal or generally in a data signal, e.g. background noise, which can lead to comb filter effects in the hearing aid in the manner described above, independently of the audio signal.

The invention also mentions a hearing aid having at least one input transducer, at least one output transducer and one control unit which is configured for performing the method described above. The advantages specified for the method and its developments can be transferred analogously to the hearing aid.

Other features which are considered as characteristic for the invention are set forth in the appended claims.

Although the invention is illustrated and described herein as embodied in a method for operating a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Mutually corresponding parts and sizes are provided with the same reference symbols in each case in all figures.

Figure 1:
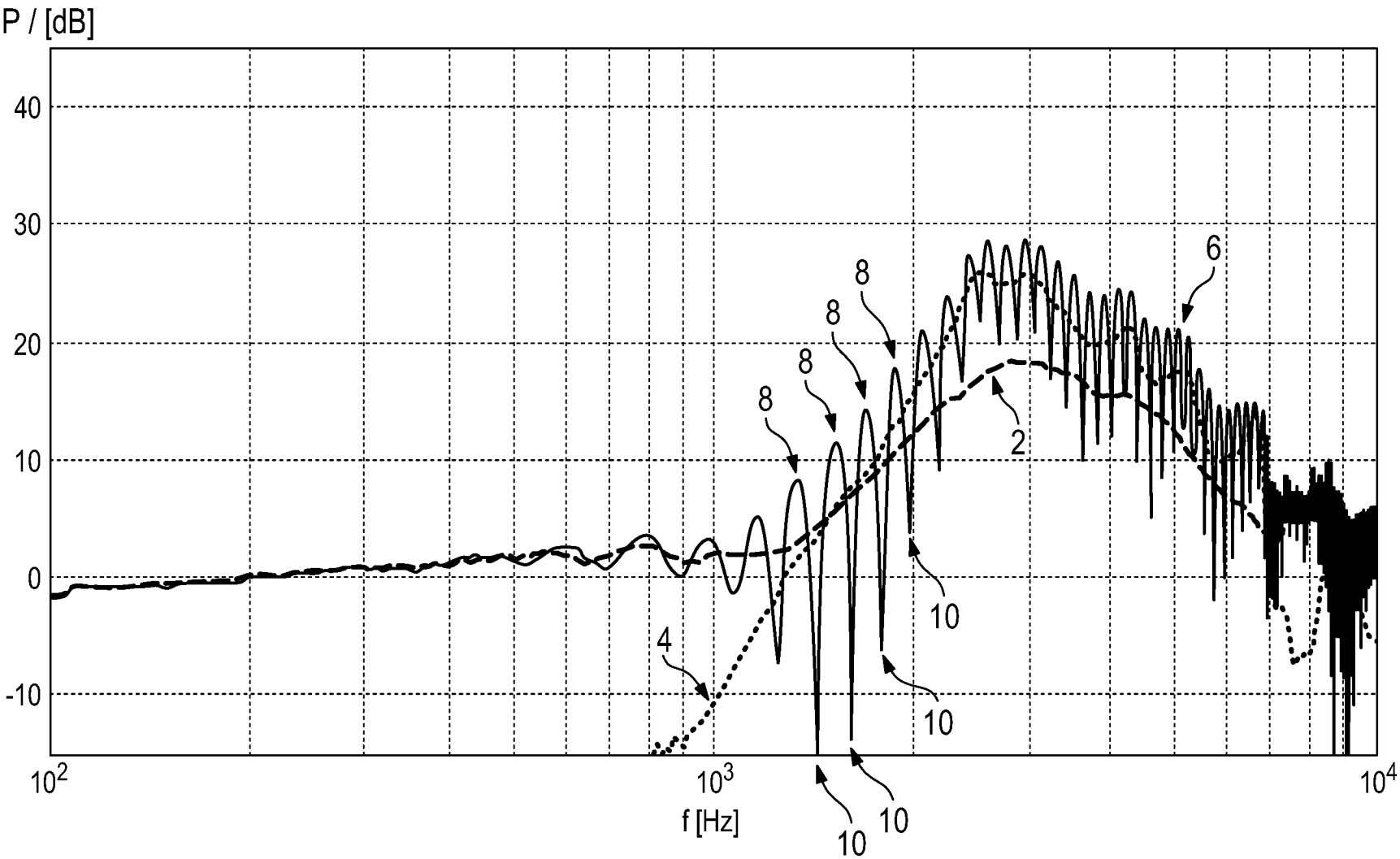
FIG. 1 is a graph showing in each case a frequency response for a sound signal, for a corresponding output sound signal of a hearing aid and for the heterodyned sound signal with comb filter effects.

Referring now to the figures of the drawings in detail and first, particularly to FIG. 1 thereof, there is shown a frequency response for a direct sound signal 2 (dashed line), for an amplified output sound signal 4 of a hearing aid (dotted line) and a heterodyned sound signal 6 (continuous line) in that in each case the sound level P is plotted against a frequency f. The direct sound signal 2 is here user-specifically amplified by a hearing aid not shown in greater detail in FIG. 1 and output as output sound signal 4 by the output transducer of the hearing aid. Due to the time delay in the signal processing in the hearing aid which, in particular, contains a frequency-band-dependent amplification of an input signal and thus a frequency-band-dependent filtering of this input signal, the direct sound signal 2 and the output sound signal 4 become heterodyned with a time delay.

It is now apparent from the heterodyned sound signal 6 that, at particular frequencies, the time-delayed heterodyning results in constructive interference 8, which overall results in an increased sound level in the heterodyned sound signal 6. On the other hand, at some frequencies, the time-delayed heterodyning results in destructive interference 10 which occasionally even results in almost complete deletion in the heterodyned sound signal 6. In this case, the maxima for the constructive interference 8 are each at integer multiples of that frequency which corresponds to the reciprocal time delay in the hearing aid, and the minima of the destructive interference 10 are each at half-integer multiples of this frequency. Depending on the frequency response of the sound signal 2, the user-specific amplification for producing the output sound signal 4 and the time delay which occurs, the comb filter effects which occur can be perceived as very unpleasant by the user of the hearing aid.

Figure 2:
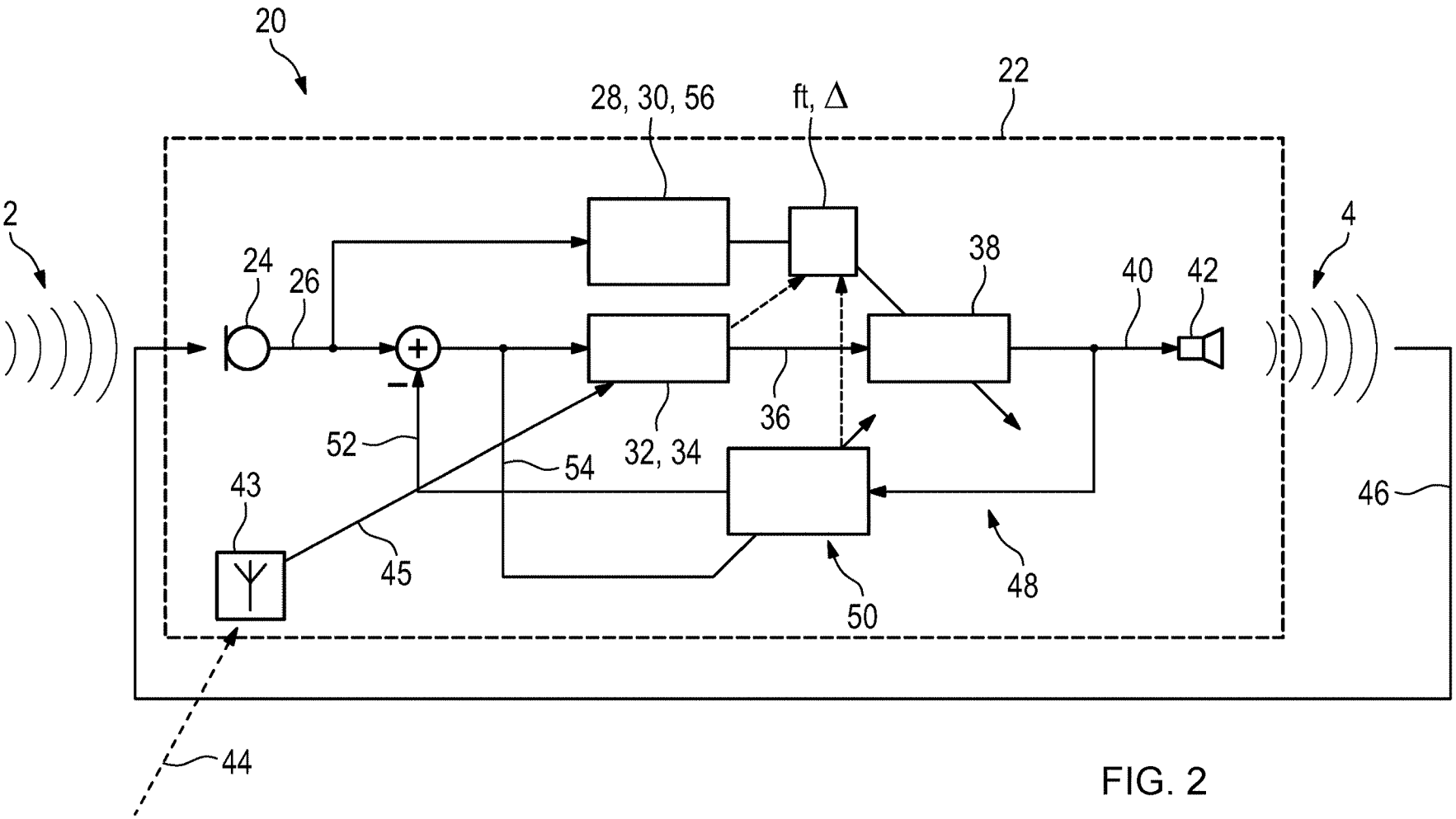
FIG. 2 is a block diagram of a method for a possible operation of a hearing aid, wherein comb filter effects are suppressed if possible.

FIG. 2 schematically illustrates a block diagram of a method 20 which is intended to prevent, as far as possible, a negative hearing sensation caused to the user by comb filter effects during operation of a hearing aid 22. An input transducer 24, which is provided in the present case by a microphone, generates an input signal 26 from the sound signal 2 of the environment. Possible linear pre-amplification of the input signal 26 is already incorporated in this case in the input transducer 24. The current hearing situation of the user of the hearing aid 22 is now classified 28 on the basis of the input signal 26. A conversation without background noise, a conversation with background noise, listening to music, driving in an automobile, a plurality of simultaneous conversations with a considerable amount of heterodyned background noise (so-called "cocktail party" hearing situation) etc., for example, come into consideration in this case as hearing situations.

Furthermore, parameters 30, on the basis of which it is possible to make statements relating to the tonality, loudness, stationarity and reverberation time of the sound signal 2, are determined on the basis of the input signal 26. After the hearing situation has been classified 28 and the parameters 30 have been determined, the input signal 26 is supplied to a signal processing unit 32 in which the user-specific signal processing 34 which is conventional for the hearing aid 22 is carried out on the basis of the user's audiological requirements. In this case, the signal processing 34 contains, in particular, a decomposition of the input signal 26 into various frequency bands, amplification of the input signal 26 using gain factors which are dependent on the frequency band, and noise suppression processes which are dependent on the frequency band and may likewise depend on the classification 28 of the hearing situation. The signal processing unit 32 now outputs a first intermediate signal 36, to which a frequency distortion 38 is applied in a manner yet to be described. This produces an output signal 40 which is converted into the output sound signal 4 by an output transducer 42 of the hearing aid 22. In the present case, the output transducer 42 is provided by a loudspeaker.

Moreover, the hearing aid 22 has a signal receiver 43 for receiving a data signal 44 in which an audio signal 45 is coded. In this case, the signal receiver 43 may be provided, for example, by an antenna apparatus and the data signal 44 may be provided, for example, by a Bluetooth signal. In this case, the audio signal 45 can be decoded from the data signal 44 by a processor of the signal receiver 43 which is specifically set up for this purpose. Alternatively, the audio signal 45 can also be decoded from the data signal 44 only in the signal processing unit 32. The audio signal 45, if present, is processed by the signal processing unit 32 and is included in the first intermediate signal 36.

In order to suppress possible acoustic feedback 46 which can occur as a result of the output sound signal 4 being injected into the input transducer 24 again, the output signal 40 is also branched off into a feedback loop 48. In the feedback loop 48, a second intermediate signal 52 is derived from the output signal 40 by means of an adaptive filter 50, which second intermediate signal is supplied to the input signal 26 for the purpose of compensating for the acoustic feedback 46. The input signal 26 which has now been compensated for with the second intermediate signal 52 is supplied in this case as an error signal 54 to the adaptive filter 50 as a further input variable.

In the present case, the frequency distortion 38 is provided by a frequency shift which constantly shifts the first intermediate signal 36 by a fixed amount Δ above a dividing frequency ft. In order to determine the dividing frequency ft and the amount Δ of the shift, a comb filter parameter 56 is first of all determined on the basis of the classification 28 of the hearing situation and the parameters 30 relating to the tonality, loudness, stationarity and reverberation time of the sound signal 2 of the environment, which comb filter parameter indicates the probability of the occurrence of a comb filter effect and its possible intensity in the present hearing situation and for the present parameters 30.

In order to determine the dividing frequency ft and the amount Δ of the shift, it can now be taken into account, on the one hand, that the frequency shift decorrelates the output sound signal 4 from the sound signal 2 of the environment, which, in principle, suppresses the formation of comb filter effects. This decorrelating effect may likewise affect the suppression of the acoustic feedback 46, which is why the dividing frequency ft and the amount Δ of the shift can also be concomitantly predefined on the basis of the acoustic feedback 46 to be suppressed, for example by means of corresponding correlation measurements in the adaptive filter 50. In particular, the parameters 30 which characterize the sound signal 2 of the environment can be concomitantly included for the determination of the dividing frequency ft and the amount Δ of the shift of the frequency shift in such a manner that possible beats which can occur between the sound signal 2 and the output sound signal 4 are concomitantly taken into account.

In addition, signal-internal heterodyning of signal components, to which the frequency shift has been applied, with those signal components which consist of the unaltered first intermediate signal 36 in the output signal 40 may also be concomitantly taken into account. Specifically, this means that the dividing frequency ft, in particular, should preferably be placed such that such heterodyning of the signal components as a result of the finite steepness of the filters used have the smallest possible effects in the output signal 40. This can be achieved, for example, by placing the dividing frequency ft in a frequency band with particularly low signal energy. The definitive determination of the dividing frequency ft and of the amount Δ of the shift can then therefore be carried out in an optimization process for a plurality of variables, which is to be carried out in an accordingly prioritized manner on the basis of the present hearing situation, the sound properties of the sound signal 2 which are determined by the parameters 30, possible acoustic feedback 46 and possible heterodyning of the individual signal components. In this case, the highest priority can first of all be granted to efficient suppression of the acoustic feedback 46, and the frequency shift can then be set primarily on the basis of the hearing situation and the tonality determined for the sound signal 2 in such a manner that beats are to be avoided as far as possible for particularly tonal sound signals 2 and the frequency shift is accordingly smaller, whereas the occurrence of comb filter effects should be avoided for particularly broadband, atonal signals and the dividing frequency ft should accordingly already have been selected in a low frequency range. The definitive determination of the dividing frequency ft can then be determined on the basis of the signal energies of individual frequency bands of the frequency range which has already been predefined in order to minimize the effects of heterodyning frequency-shifted signal components with signal components which have not been frequency-shifted in the output signal.

Figure 3:
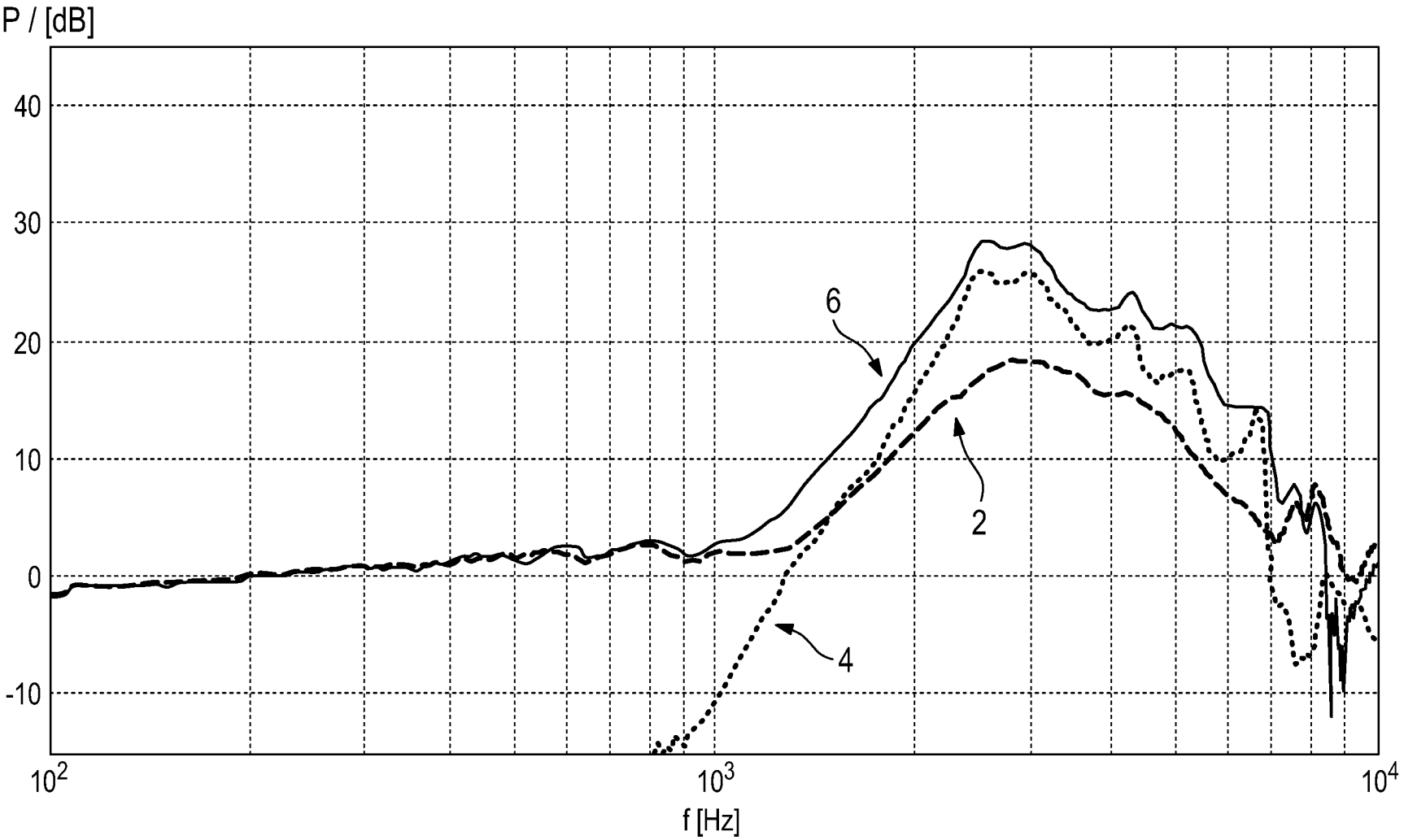
FIG. 3 is a graph showing in each case the frequency response for the sound signal, the output sound signal and the heterodyne sound signal when applying the method according to FIG. 2.

In a comparable manner to FIG. 1, FIG. 3 respectively illustrates the frequency response for the direct sound signal 2 (dashed line), for the output sound signal 4 (dotted line) and for the heterodyned sound signal 6 (solid line). In this case, the method 20 according to FIG. 2 was used when forming the output sound signal 4. It can now be discerned that the relatively broadband atonal sound signal 2 now no longer results in the occurrence of comb filter effects during heterodyning with the output sound signal 4.

Although the invention has been illustrated and described further in detail by the preferred illustrative embodiment, the invention is not restricted by this illustrative embodiment. Other variations can be derived from this by the person skilled in the art without departing from the protective scope of the invention.

The following is a summary list of reference numerals and the corresponding structure used in the above description of the invention:

2 Sound signal of the environment
4 Output sound signal
6 Heterodyned sound signal
8 Constructive interference
10 Destructive interference
20 Method
22 Hearing aid
24 Input transducer
26 Input signal
28 Classification
30 Parameter
32 Signal processing unit
34 Signal processing
36 First intermediate signal
38 Frequency distortion/displacement
40 Output signal
42 Output transducer
43 Signal receiver
44 Data signal
45 Audio signal
46 Acoustic feedback
48 Feedback loop
50 Adaptive filter
52 Second intermediate signal
54 Error signal
56 Comb filter parameter
ft Division frequency
Δ Amount of the frequency shift

The invention claimed is:

1. A method for operating a hearing aid having at least one input transducer and at least one output transducer, which comprises the steps of:

generating an input signal, via the at least one input transducer, from a sound signal of an environment;

determining, via the input signal, a classification of a hearing situation of the environment and/or determining at least one of four parameters selected from the group consisting of tonality, loudness, stationarity and reverberation time for the sound signal of the environment;

generating a first intermediate signal in dependence on the input signal by signal processing;

predetermining, via the classification of the hearing situation and by at least one of the four parameters, at least one parameter of a frequency distortion for decorrelating the first intermediate signal from the input signal, and applying the frequency distortion to the first intermediate signal for suppressing an occurrence of a comb filter effect.

2. The method according to claim 1, wherein the at least one parameter of the frequency distortion is additionally specified in dependence on at least one parameter of the signal processing.

3. The method according to claim 1, which further comprises determining a comb filter parameter by means of the classification of the hearing situation and by means of the at least one of the four parameters including the tonality, the loudness, the stationarity and the reverberation time, the comb filter parameter specifies a probability value for an occurrence and/or an intensity of a comb filter effect and wherein the at least one parameter of the frequency distortion is additionally specified in dependence on the comb filter parameter.

4. The method according to claim 1, which further comprises:

generating an output signal by an application of the frequency distortion to the first intermediate signal; and converting the output signal into an output sound signal by the at least one output transducer.

5. The method according to claim 4, wherein the at least one parameter of the frequency distortion is predetermined additionally in dependence on an acoustic heterodyne, to be expected, of frequency-distorted signal components of the output sound signal with the sound signal of the environment.

6. The method according to claim 4, wherein the at least one parameter of the frequency distortion is additionally specified in dependence on a heterodyne, to be expected, of frequency-distorted signal components of the first intermediate signal with non-frequency-distorted signal components of the first intermediate signal in the output signal.

7. The method according to claim 1, wherein the at least one parameter of the frequency distortion is given by a function of a change of an output frequency in dependence on an input frequency.

8. The method according to claim 7, which further comprises applying a frequency shift as the frequency distortion and in this context the at least one parameter of the frequency distortion is given by a carrier of the function and/or a value of the frequency shift.

9. The method according to claim 1, which further comprises:

supplying a frequency-distorted first intermediate signal to a feedback loop;

deriving a second intermediate signal from the frequency-distorted first intermediate signal in the feedback loop; and adding the second intermediate signal to the input signal for suppressing an acoustic feedback.

10. The method according to claim 9, wherein the at least one parameter of the frequency distortion is specified additionally in dependence on the acoustic feedback to be suppressed.

11. The method according to claim 1, wherein:

a data signal corresponding to an audio signal is received by a signal receiver of the hearing aid; and the at least one parameter of the frequency distortion is specified additionally in dependence on the audio signal.

12. A hearing aid, comprising:

at least one input transducer;

at least one output transducer; and a control unit programmed to operate the hearing aid and perform the following steps of:

generating an input signal, via said at least one input transducer, from a sound signal of an environment;

determining, via the input signal, a classification of a hearing situation of the environment and/or determining at least one of four parameters selected from the group consisting of tonality, loudness, stationarity and reverberation time for the sound signal of the environment;

generating a first intermediate signal in dependence on the input signal by signal processing;

predetermining, via the classification of the hearing situation and by at least one of the four parameters, at least one parameter of a frequency distortion for decorrelating the first intermediate signal from the input signal; and applying the frequency distortion to the first intermediate signal for suppressing an occurrence of a comb filter effect.

* * * * *